US009812274B2

(12) United States Patent
Haehnel et al.

(10) Patent No.: US 9,812,274 B2
(45) Date of Patent: Nov. 7, 2017

(54) ARRANGEMENT FOR AN ELECTRICAL SWITCH ELEMENT WITH A SEAL CONFIGURATION

(71) Applicant: TE Connectivity Germany GmbH, Bensheim (DE)

(72) Inventors: Thomas Haehnel, Berlin (DE); Albert Koetter, Berlin (DE); Christian Maranke, Luechfeld (DE); Rene Wagner, Berlin (DE); Titus Ziegler, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/943,592

(22) Filed: Nov. 17, 2015

(65) Prior Publication Data

US 2016/0071669 A1 Mar. 10, 2016

Related U.S. Application Data

(63) Continuation of application No. PCT/EP2014/061011, filed on May 28, 2014.

(30) Foreign Application Priority Data

May 31, 2013 (DE) ..... 10 2013 210 194

(51) Int. Cl.
*H01H 33/04* (2006.01)
*H01H 50/02* (2006.01)
*H01H 50/30* (2006.01)

(52) U.S. Cl.
CPC ..... *H01H 33/04* (2013.01); *H01H 50/023* (2013.01); *H01H 50/30* (2013.01)

(58) Field of Classification Search
CPC ..... H01H 33/04; H01H 9/04; H01H 50/023; H01H 50/30; H01H 13/063; H01H 51/29; H01H 51/22; H01H 51/288; H01H 51/00
(Continued)

(56) References Cited

U.S. PATENT DOCUMENTS 3,781,727 A * 12/1973 Pollmann ..... H01H 50/22 335/132
4,983,941 A 1/1991 Tanaka
(Continued)

FOREIGN PATENT DOCUMENTS

CN 101231922 A 7/2008
CN 101364502 A 2/2009
DE 3818562 A1 12/1989

OTHER PUBLICATIONS

PCT Search Report and Written Opinion, International Application No. PCT/EP2014/061011, dated Jul. 30, 2014, 10 pages.
(Continued)

*Primary Examiner* — Renee S Luebke
*Assistant Examiner* — William Bolton
(74) *Attorney, Agent, or Firm* — Barley Snyder

(57) ABSTRACT

An electrical switch element is disclosed. The electrical switch element has a switch chamber having contacts and an opening, a propulsion element extending through the opening in the switch chamber and having an annular flange, and a seal configuration having an annular protrusion surrounding the opening. The propulsion element is movable within the opening to open or close the contacts, and in an end position of the propulsion element, the annular flange abuts the annular protrusion.

17 Claims, 3 Drawing Sheets

(58) Field of Classification Search
USPC ..... 218/154, 155, 30, 31; 335/71, 127, 133, 335/151, 201, 202, 225
See application file for complete search history.

(56) References Cited

U.S. PATENT DOCUMENTS 5,635,886 A * 6/1997 Pichard ..... H01H 73/045 335/132
5,844,457 A * 12/1998 Eckroth ..... H01H 50/64 335/132
5,973,581 A 10/1999 Jacquin et al.
6,204,460 B1 * 3/2001 Hojo ..... H01H 1/66 200/302.2
6,377,143 B1 * 4/2002 Zhou ..... H01H 50/546 335/132

OTHER PUBLICATIONS

Abstract of DE3818562, dated Dec. 7, 1989, 1 page.
English translation of Chinese First Office Action, dated Nov. 28, 2016, 9 pages.
Abstract of CN101231922, dated Jul. 30, 2008, 1 page.
Abstract of CN101364502, dated Feb. 11, 2009, 1 page.

* cited by examiner

ARRANGEMENT FOR AN ELECTRICAL SWITCH ELEMENT WITH A SEAL CONFIGURATION

CROSS-REFERENCE TO RELATED APPLICATIONS

This application is a continuation of PCT/EP2014/061011 filed May 28, 2014, which claims priority under 35 U.S.C. §119 to German Patent No. 102013210194.5 filed May 31, 2013.

FIELD OF THE INVENTION

The invention concerns an electrical switch element, and more particularly, an electrical switch element with a switch chamber.

BACKGROUND

Electrical switch elements such as relays or contactors are standard components that have long been used in electrical engineering. When the contacts are opened, in particular at high current strength, arcs frequently form between the contacts. Arc formation is problematic on the one hand because the arcs are conduits, such that, as long as an arc is present, the electrical switch is not interrupted, and, on the other, because the hot plasma of the arc may damage the components of the electrical switch element both inside and outside of the switch chamber. This results in a reduced useful life of the switch elements.

SUMMARY

The object of the invention is to provide an arrangement for an electrical switch element that facilitates the elimination of any arcs and increases the useful life of the switch without increasing manufacture costs. The disclosed electrical switch element has a switch chamber having contacts and an opening, a propulsion element extending through the opening in the switch chamber and having an annular flange, and a seal configuration having an annular protrusion surrounding the opening. The propulsion element is movable within the opening to open or close the contacts, and in an end position of the propulsion element, the annular flange abuts the annular protrusion.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical switch element.

This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
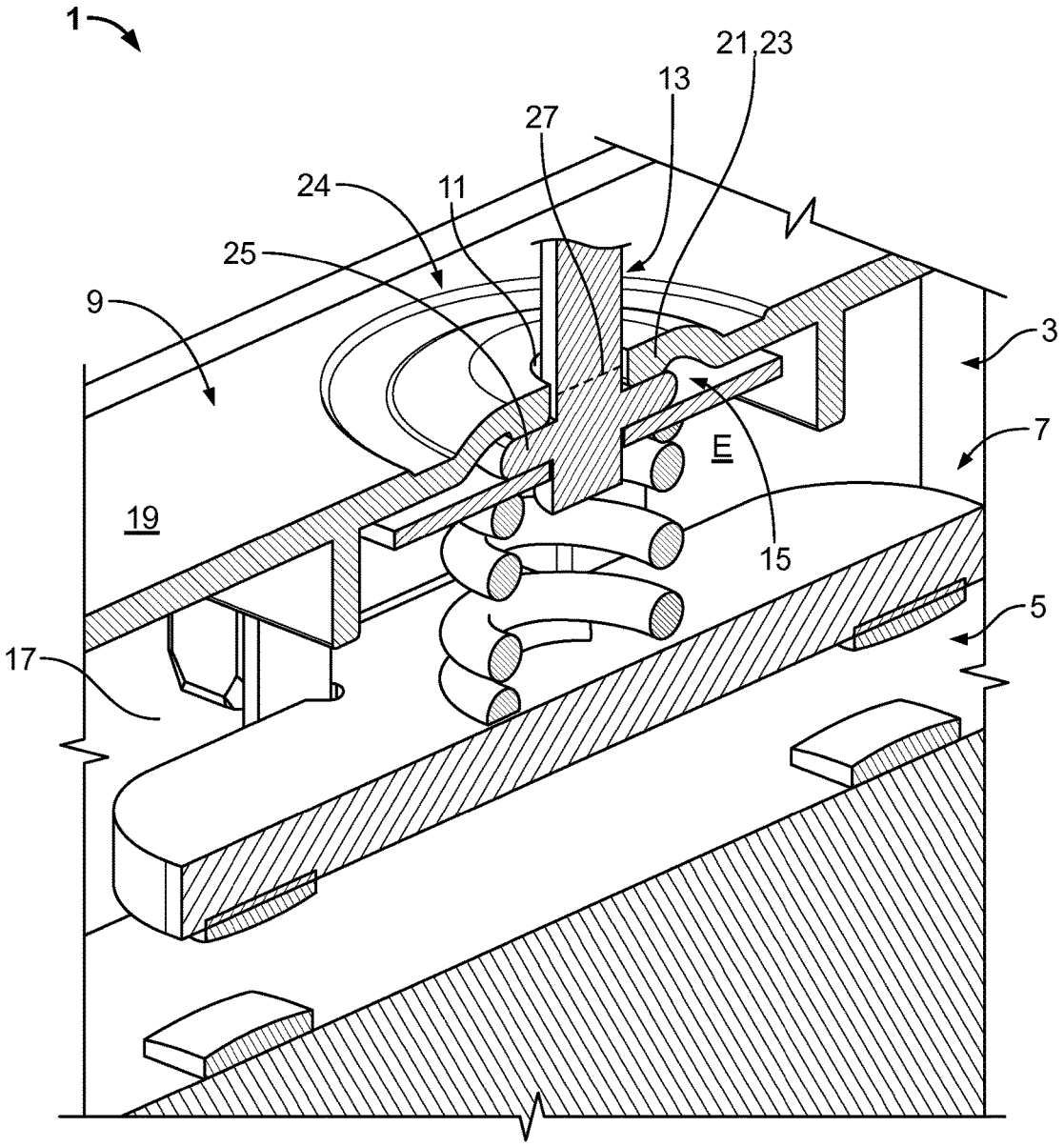
FIG. 1 is a cross-section of part of an electrical switch element according to a first embodiment of the invention.

FIG. 1 shows an embodiment of an arrangement of an electrical switch element 1 according to the invention in cross-section. The arrangement for an electrical switch element 1 comprises a switch chamber 3. The switch chamber 3 contains contacts 5. The contact arrangement 7 shown, which is configured in the form of a contact bridge to connect two contacts 5, is meant merely as an example of contacts 5 capable of opening and/or closing.

The switch chamber 3 has a wall 9, which has an opening 11. A propulsion element 13 protrudes through the opening 11 into the switch chamber 3. The propulsion element 13 is functionally coupled with the contacts 5. In FIG. 1, the propulsion element 13 is in its end position E. The propulsion element 13 is surrounded by the seal configuration 15. In the end position E of the propulsion element 13, the opening 11 is sealed by the seal configuration 15. The inside 17 of the switch chamber 3 is separated from the area 19 outside the switch chamber in the end position E.

The seal configuration 15 includes a stationary part 21 of the wall 9 and an annular flange 25 of the propulsion element 13.

The stationary part 21 extends annularly around the opening 11, and is formed as an annular protrusion 23. The stationary part 21 is part of the wall section 24, which also contains the opening 11. The protrusion 23 is formed so as to thicken the wall 9 in this exemplary embodiment. However, the protrusion 23 may also be formed by an additional element that abuts the wall 9. The protrusion 23 protrudes into the switch chamber 3.

The annular flange 25 on the propulsion element 13 protrudes in parallel to a plane 27 of the opening 11. The annular flange 25 may be integrally formed with the propulsion element 13.

Figure 2:
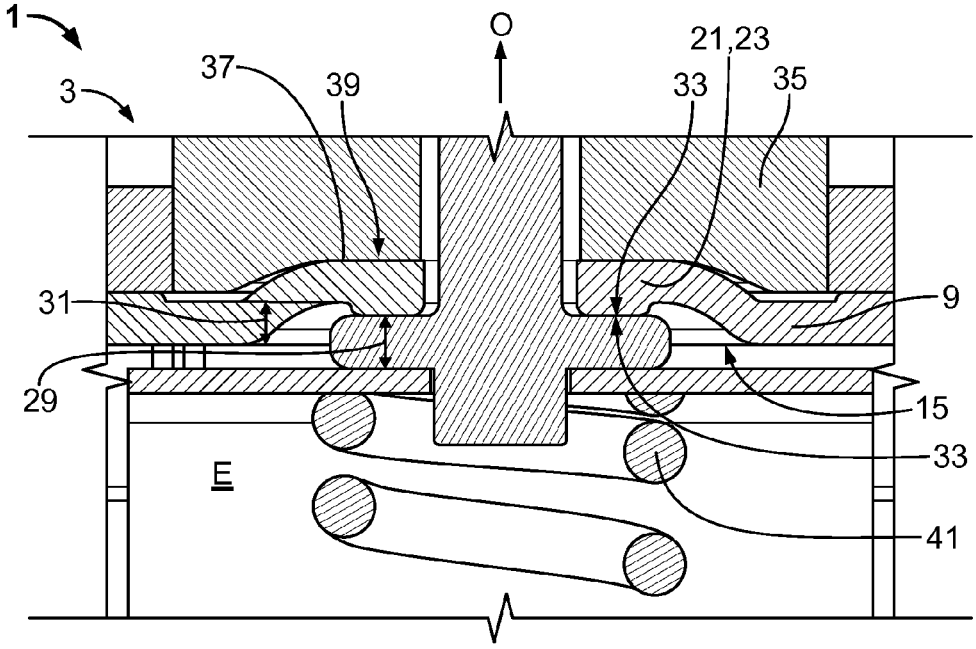
FIG. 2 is a cross-section of a seal configuration according to the first embodiment.

The structure and function of the seal configuration 15 are further described in FIG. 2. FIG. 2 shows an enlargement of the seal configuration 15 according to the invention from FIG. 1 in cross-section.

The annular flange 25 abuts the annular protrusion 23 in the end position E, and completely overlaps with the opening 11. This completely seals the switch chamber 3. The side of the flange 25 facing the stationary part 21 forms a sealing surface 33; the side of the protrusion 23 facing the flange 25 forms the sealing surface 33'. In the end position E, the sealing surfaces 33 and 33' abut each other, thus sealing the switch chamber 3. Further, in the end position E, the section 24 having the opening 11 is positioned apart from the switch chamber 3 by a distance 31. This distance 31 roughly corresponds to the thickness 29 of the flange 25.

A support element 35 of the switch element 1 may abut an outer side 37 of the section 24 on the switch chamber 3.

The functioning of the seal configuration 15 will now be described. The propulsion element 13 begins in a switching position (not shown), in which the contacts 5 are closed. If the contacts are opened and an arc (not shown) forms within the switch chamber 3, the gas heated by the arc inside the switch chamber 3 seeks to leave the switch chamber 3 via the opening 11. The pressure of the gas forces the propulsion element 13 along the opening direction O into the end position E; the annular protrusion 23 may serve as a stop for the flange 25, thus defining the end position E of the propulsion element 13. The end position E is reached by the propulsion element 13 when the opening of the contacts 5 is complete.

In order to reduce the stress on the material of the wall section 24 when the flange 25 collides with the protrusion 23, the support element 35 abutting an outer side 37 of the section 24 may absorb part of the kinetic energy of the propulsion element 13.

The switch element 1 may have a damping configuration 39. In a particularly simply produced embodiment, the protrusion 23 is part of the damping configuration 39. To this end, the protrusion 23 may be made of a soft or elastic material, or the wall section 24 may be made of an elastic material. The wall section 24 and the annular protrusion 23 may be produced by means of multi-component injection moulding, whereby the annular protrusion 23 may be made of a more elastic material than the rest of the wall section 24.

In a variation (not shown), the flange 25 may directly abut a spring element 41 of the switch element 1. The side of the flange 25 facing away from the wall 9 may be configured such that the spring element 41 may be directly supported by it. In particular, the annular flange 25 may have a greater diameter than the spring element 41.

Figure 3:
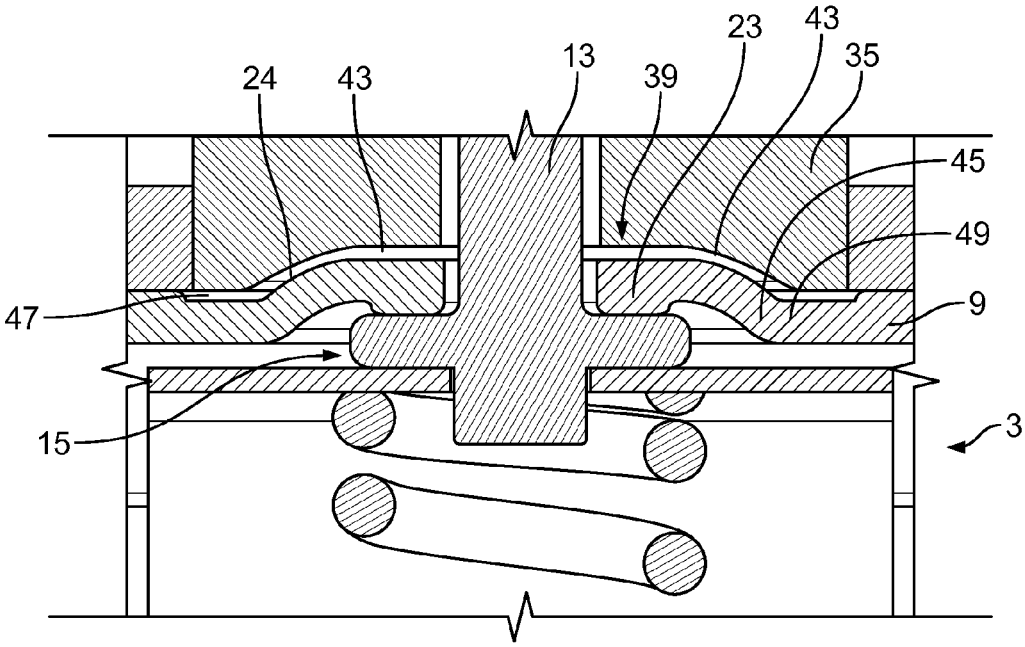
FIG. 3 is cross-section of a seal configuration according to a second embodiment of the invention.

FIG. 3 shows another embodiment of a seal configuration of an electrical switch element 1 according to the invention.

The support element 35 adjacent to the switch chamber 3 is positioned apart from the switch chamber 3, such that a movement space 43 is formed between the wall section 24 and the adjacent support element 35. The movement space 43 runs annularly around the propulsion element 13. The switch chamber 3 of the wall 9 has an elastically deflectable wall section 45. The wall section 45 may be part of the wall section 24 having the opening 11, or be identical to it. The elastically deflectable wall section 45 may deviate elastically into the movement space 43. The wall section 45 thus serves to absorb the movement of the propulsion element 13 in its resting position. The movement space 43 and the wall section 45 are part of the seal configuration 39. The wall section 45 may have an annular area 49 with a greater wall thickness than the rest of the wall 9 in order to increase its elasticity.

The adjacent support element 35 delimits the movement space 43 in a direction away from the switch chamber 3. The adjacent support element 35 may be made, e.g., of part of a propulsion system (not shown). The adjacent support element 35 may, e.g., be part of a coil core surrounding the propulsion element 13. The wall 9 may have a receiving groove 47, which may run annularly around the opening, on the side facing the adjacent support element 35. The groove 47 may serve to fasten and align an adjacent support element 35. The groove 47 may form the annular space 49 with a reduced wall thickness compared to the rest of the wall 9.

Figure 4:
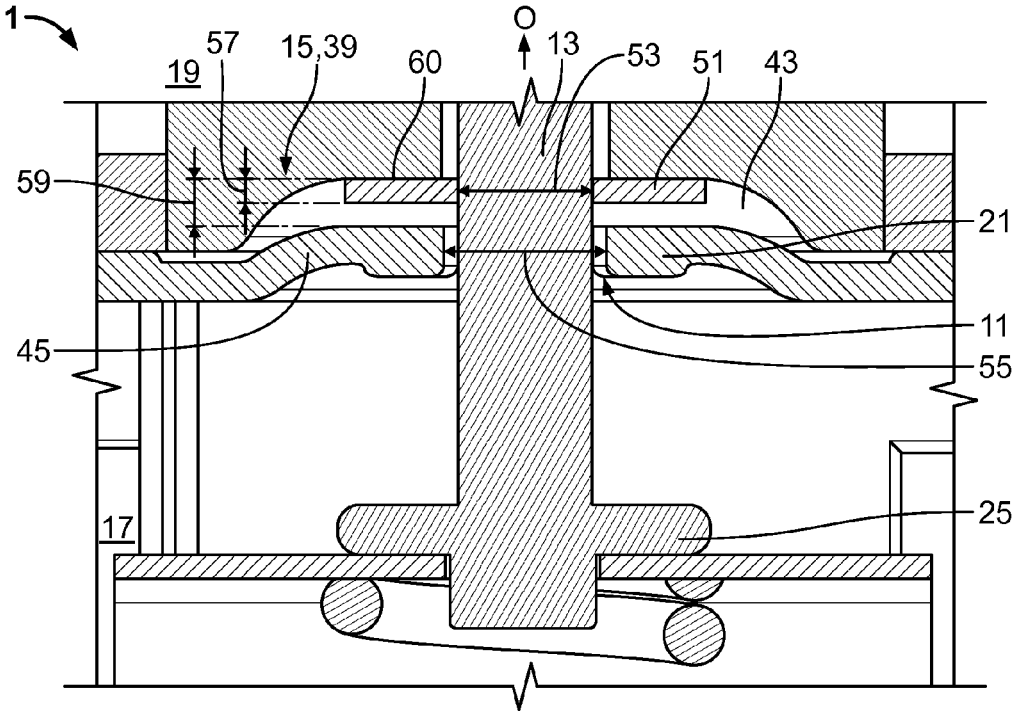
FIG. 4 is a cross-section of a seal configuration according to a third embodiment of the invention.

FIG. 4 shows part of another embodiment of an electrical switch element 1 according to the invention. FIG. 4 shows the propulsion element 13 outside of its end position E.

The movement space 43 contains an annular secondary sealing element 51. The secondary sealing element 51 is penetrated by the propulsion element 13. An internal diameter 53 of the secondary sealing element 51 is smaller than an internal diameter 55 of the opening 11. The secondary sealing element 51 may be configured such that it tightly surrounds the propulsion element 13.

The secondary sealing element 51 may have a thickness 57 smaller than a width 59 of the movement space in a direction parallel to the opening direction O of the propulsion element 13. The secondary sealing element 51 is not connected with the propulsion element 13 in a fixed manner, and can move parallel to the opening direction O within the movement space 43. The secondary sealing element 51 is both part of the seal configuration 15 and of the damping configuration 39.

The functioning of the secondary sealing element 51 is described below: If the propulsion element 13 is in a switching position (not shown), the position of the secondary sealing element 51 is undefined within the movement space 43. If the contacts are opened and an arc (not shown) forms within the switch chamber 3, the gas heated by the arc inside the switch chamber 3 seeks to leave the switch chamber 3 via the opening 11. The movement of the gas through the opening 11 can press the secondary sealing element 51 onto the inner side 60 of the movement space opposite the opening 11. The secondary sealing element 51 then abuts the inner side 60. Because the secondary sealing element 51 surrounds the propulsion element 13, the movement space 43, and thus the inside 17 of the switch chamber 3 as well, is closed off from the area 19 outside of the switch chamber 3.

The secondary sealing element 51 already seals the switch chamber 3 before the propulsion element 13 reaches its end position E. If the propulsion element 13 moves quickly in the opening direction O, the flange 25 will collide with the stationary part 21. This moves the elastically deflectable wall section 45 into the movement space 43, and may hit the secondary seal element 51. The secondary sealing element 51 may be made of an elastic material and effectively absorb the movement of the wall section 45. If the propulsion element 13 has reached its end position E (not shown), in addition to the seal provided by the secondary sealing element 51, which abuts the inner side 60, the switch chamber 3 is additionally closed and sealed due to the fact that the annular flange 25 abuts the stationary part 21.

Figure 5:
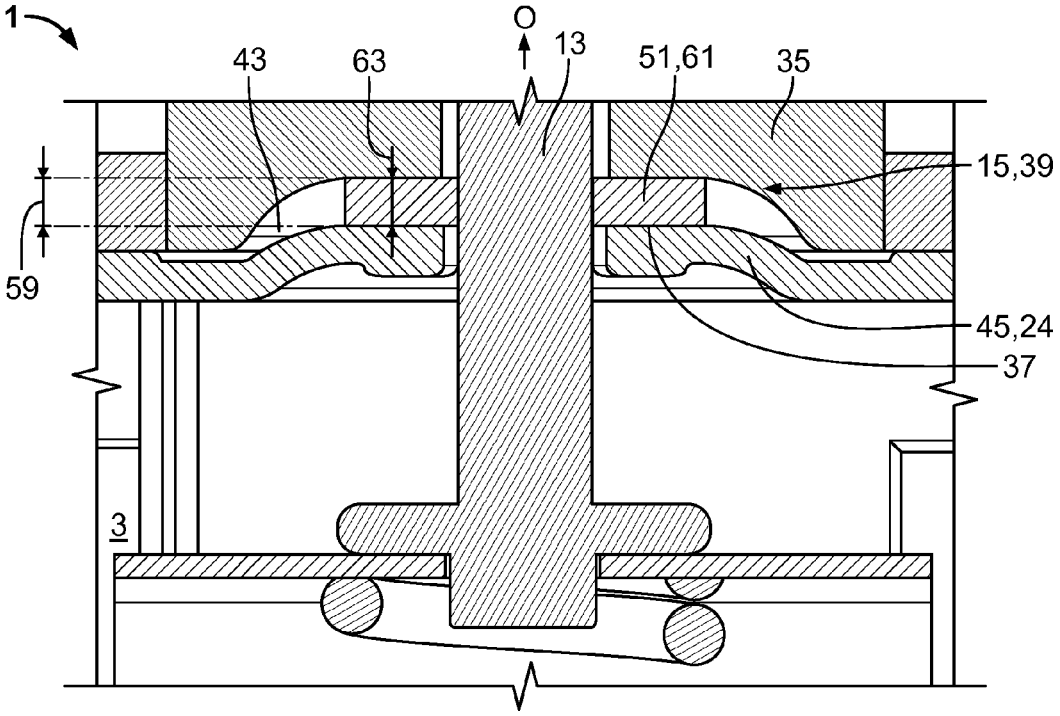
FIG. 5 is a cross-section of a seal configuration according to a fourth embodiment of the invention.

FIG. 5 shows part of another embodiment of a switch element 1 according to the invention. The secondary sealing element 51 is formed as a press-fit element 61.

The thickness 63 of the press-fit element 61 corresponds at least to the width 59 of the movement space 43. If the thickness 63 of the press-fit element 61 is greater than the width 59 of the space 43, the press-fit element 61 is press-fit into the space 43 by the pressure exerted by the wall section 45, and abuts both the outer side 37 of the wall section 24 and the inner side 60 opposite the opening 11.

Because the press-fit element 61 tightly surrounds the propulsion element 13, it is a permanent seal that seals the switch chamber 3 off from the area 19 outside of the switch chamber 3 in every position of the propulsion element 13. The press-fit element 61 is thus part of the seal configuration 15. If the press-fit element 61 itself is made of elastically deformable material, it additionally serves as part of the damping configuration 39, as it effectively absorbs movement of the elastically deflectable wall section 45 into the space 43. The wall section 45 directly abuts the press-fit element 61.

Because the press-fit element 61 is held by force in the space 43, it can form an additional guide for the propulsion element 13. This can improve the reliability of the electrical switch element 1. The press-fit element 61 may be equipped, e.g., by means of its dimensions or material properties, such that it can only be moved perpendicularly to the opening direction O with increased force. In particular, it may be configured such that, at the first operation of an assembled electrical switch element 1, imprecisions in production and/or assembly are compensated by the fact that, when the propulsion element 13 moves, the press-fit element 61 initially moves a certain distance in the movement space perpendicularly to the opening direction O, until the propulsion element 13 is arranged in a position that may be specified by additional elements of the electrical switch element. The movability of the press-fit element 61 perpendicularly to the opening direction O thus ensures that the propulsion element can move without tension in and opposite the opening direction O during the further operation of the electrical switch element 1.

The solution of the invention has the advantage that the seal configuration effectively seals the switch chamber opening after the contacts have been separated. This keeps any plasma generated by an arc in the switch chamber inside the switch chamber. This prevents damage to the components of the electrical switch element outside the switch chamber. Because the plasma and the hot gas surrounding the plasma are limited to the volume of the switch chamber, the increased pressure that builds up in the switch chamber shortly after the formation of an arc also effectively facilitates the elimination of the arc. This interrupts the current flow and reduces any adverse effect on the components inside the switch chamber.

What is claimed is:

1. An electrical switch element, comprising:

a switch chamber having contacts and an opening formed in an outer wall;

a propulsion element having an annular flange, being movable within the opening and functionally coupled to the contacts; and a seal configuration having an annular protrusion surrounding the opening, a portion of the annular protrusion protruding from the outer wall into the switch chamber and abutting the annular flange.

2. The electrical switch element according to claim 1, wherein the annular flange is integrally formed with the propulsion element.

3. The electrical switch element according to claim 1, wherein the contacts are open in an end position.

4. The electrical switch element according to claim 1, wherein the annular protrusion is part of the outer wall.

5. The electrical switch element according to claim 4, wherein the annular flange abuts a surface of the annular protrusion that is inside the switch chamber.

6. The electrical switch element according to claim 5, wherein the annular protrusion is an elastic material.

7. The electrical switch element according to claim 6, wherein an annular wall section of the outer wall surrounds the annular protrusion, and a thickness of the annular wall section is less than a thickness of both the annular protrusion and the rest of the outer wall.

8. The electrical switch element according to claim 7, wherein the annular wall section is an elastic material.

9. The electrical switch element according to claim 6, wherein a support element abuts a surface of the annular protrusion that is outside the switch chamber.

10. The electrical switch element according to claim 6, wherein a support element is positioned to define a movement space between the support element and a surface of the annular protrusion that is outside the switch chamber.

11. The electrical switch element according to claim 10, further comprising an annular secondary sealing element positioned in the movement space.

12. The electrical switch element according to claim 11, wherein the propulsion element extends through a hole in the secondary sealing element.

13. The electrical switch element according to claim 12, wherein a diameter of the hole of the secondary sealing element is smaller than a diameter of the opening in the outer wall.

14. The electrical switch element according to claim 13, wherein a thickness of the annular secondary sealing element is less than a thickness of the movement space.

15. The electrical switch element according to claim 14, wherein the annular secondary sealing element is movable with respect to the propulsion element within the movement space.

16. The electrical switch element according to claim 15, wherein the annular secondary sealing element abuts the support element when the propulsion element is in an end position.

17. The electrical switch element according to claim 13, wherein the secondary sealing element is configured as a rigid press-fit element, held by force in the movement space.

* * * * *